US008362401B2

(12) United States Patent
Aritaki et al.

(10) Patent No.: US 8,362,401 B2
(45) Date of Patent: Jan. 29, 2013

(54) HEATER

(75) Inventors: Yasuyuki Aritaki, Kyoto (JP); Shinobu Obata, Kyoto (JP); Teruhisa Sako, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 1161 days.

(21) Appl. No.: 12/229,649

(22) Filed: Aug. 26, 2008

(65) Prior Publication Data

US 2009/0065492 A1 Mar. 12, 2009

(30) Foreign Application Priority Data

Sep. 10, 2007 (JP) ..... 2007-233999

(51) Int. Cl.
*G03G 15/20* (2006.01)
*H05B 3/22* (2006.01)
*H05B 3/26* (2006.01)

(52) U.S. Cl. ..... 219/219; 219/541; 219/543; 219/552; 399/328; 399/329

(58) Field of Classification Search ..... None
See application file for complete search history.

(56) References Cited

U.S. PATENT DOCUMENTS 5,083,168 A * 1/1992 Kusaka et al. ..... 399/329
5,162,635 A * 11/1992 Sato et al. ..... 219/216
5,171,969 A * 12/1992 Nishimura et al. ..... 219/216
5,204,723 A * 4/1993 Hanada et al. ..... 399/335
5,288,973 A * 2/1994 Ota et al. ..... 219/216
6,469,279 B1 * 10/2002 Ohtsuka ..... 219/216
7,848,672 B2 * 12/2010 Smith ..... 399/67
2001/0032835 A1 * 10/2001 Murooka et al. ..... 219/216
2005/0109768 A1 * 5/2005 Aoki et al. ..... 219/543
2010/0086324 A1 * 4/2010 Smith ..... 399/67
2011/0062140 A1 * 3/2011 Sakakibara ..... 219/216

FOREIGN PATENT DOCUMENTS

JP 2007-121955 5/2007

* cited by examiner

*Primary Examiner* — Joseph M Pelham
(74) *Attorney, Agent, or Firm* — Hamre, Schumann, Mueller & Larson, P.C.

(57) ABSTRACT

A toner-fixing heater includes a substrate elongated in a first direction, a resistor formed on the substrate, a wiring portion connected with the resistor, and a protective film covering the resistor. The resistor includes two belt-like portions elongated in the first direction and spaced away from each other in a second direction perpendicular to the first direction. The resistor or the wiring portion includes a conductive portion for passing an electric current in the second direction. The conductive portion may have an edge extending in nonparallel to the first direction and the second direction, or may include a first layer and a second layer formed on the first layer, where the first layer is closer to the substrate than the second layer, and the edges of the second layer are located inward of the edges of the first layer as viewed in the first direction.

2 Claims, 5 Drawing Sheets

HEATER

BACKGROUND OF THE INVENTION

1. Field of the Invention

The present invention relates to a heater incorporated in a laser printer, for example, for thermally fixing toner transferred onto recording paper.

2. Description of the Related Art

Conventionally, liner heaters are used in e.g. laser printers for heating recording paper to thermally fix the transferred toner to the recoding paper. An example of conventional heaters is disclosed in JP-A-2007-121955.

FIGS. 8 and 9 of the accompanying drawings show a heater as a reference example for better understanding of the present invention. Specifically, the illustrated heater X includes a substrate 91 having an upper surface formed with a pair of resistors 92 extending in parallel to each other in Direction x. On the substrate 91, a pair of electrodes 92 are formed near the respective ends of the elongated substrate 92. The electrodes 92 are connected with the resistors 92 by wiring portions 93. The wiring portions 93 have junctions 93*a* extending in parallel to the Direction y. The resistors 92 and part of the wiring portions 93 are covered by a protective film 95. The protective film 95 can be formed by screen printing to make a film of glass material with a squeegee moved in Direction x, and then sintering the film.

In the above method, however, the squeegee is moved to go over the junction 93*a*, and at this time the supply of the glass material tends to be insufficient at the shoulder portion of the junction 93*a*. In this case, a crack 95*a* as shown in FIG. 9 may often appear in the sintered glass material or the protective film 95. Unfavorably, the crack 95*a* can lower the withstand voltage of the protective film 95.

SUMMARY OF THE INVENTION

The present invention has been proposed under the above-described circumstances. It is therefore an object of the present invention to provide a heater having an increased withstand voltage.

According to a first aspect of the present invention, there is provided a heater comprising: a substrate elongated in a first direction; a resistor formed on the substrate and including a pair of belt-like portions elongated in the first direction, the belt-like portions being spaced away from each other in a second direction perpendicular to the first direction; a wiring portion electrically connected with the resistor; and a protective film covering the resistor. At least one of the resistor and the wiring portion includes a conductive portion for passing an electric current in the second direction, where the conductive portion has an edge extending in nonparallel, as a whole, to both the first direction and the second direction, and the conductive portion (and hence the above-mentioned edge) is covered by the protective film.

In a preferred embodiment, the edge of the conductive portion may be straight as a whole or partially straight. In the latter case, the edge of the conductive portion may be made up of first and second straight segments alternating with each other, where the first straight segments are in parallel to the first direction, and the second straight segments are in parallel to the second direction.

According to the first aspect of the present invention, it is possible to reduce the risk of the short-supplying the glass material when e.g. the glass material is applied by moving a squeegee in the first direction in forming the protective film. Accordingly, the withstand voltage of the heater will be increased.

According to a second aspect of the present invention, there is provided a heater comprising: a substrate elongated in a first direction; a resistor formed on the substrate and including a pair of belt-like portions elongated in the first direction, the belt-like portions being spaced away from each other in a second direction perpendicular to the first direction; a wiring portion electrically connected with the resistor; and a protective film covering the resistor. At least one of the resistor and the wiring portion includes a conductive portion for passing an electric current in the second direction. The conductive portion comprises a first layer and a second layer formed on the first layer, where the first layer is closer to the substrate than the second layer is, and the second layer has edges located inward of the edges of the first layer as viewed in the first direction.

With such an arrangement, it is possible to decrease the height of a gap which the squeegee needs to go over at one time. Accordingly, it is possible to reduce the risk of short-supplying the glass material, which contributes to increasing the withstand voltage of the heater.

Other characteristics and advantages of the present invention will become clearer from the following detailed description to be given with reference to the attached drawings.

DETAILED DESCRIPTION OF THE PREFERRED EMBODIMENTS

Preferred embodiments of the present invention will be described below with reference to the accompanying drawings.

Figure 1:
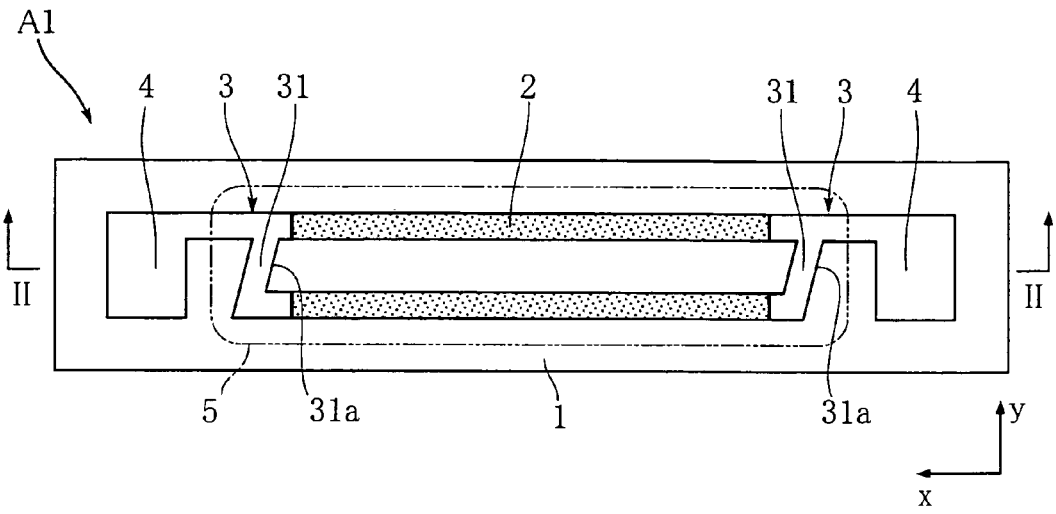
FIG. 1 is a plan view of a first embodiment of the heater according to the present invention.
Figure 2:
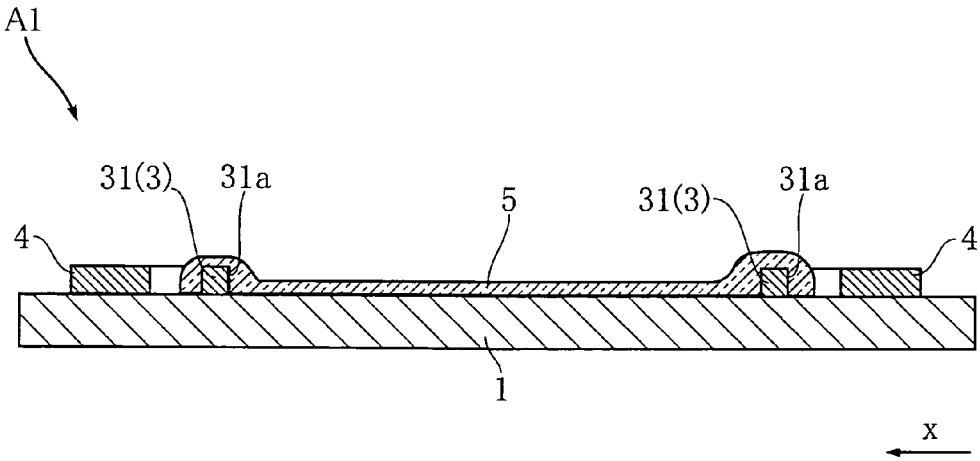
FIG. 2 is a sectional view taken in lines II-II in FIG. 1.

FIG. 1 and FIG. 2 show a first embodiment of the heater according to the present invention. The heater A1 according to the present embodiment includes a substrate 1, a resistor 2, wiring portions 3, electrodes 4, and a protective film 5. The heater A1 is used in e.g. a laser printer for heating the recording paper to thermally set the toner after the toner has been transferred onto the recording paper. It should be noted here that for the sake of easier understanding, the protective film 5 is drawn in a phantom line in FIG. 1.

The substrate 1 is long and rectangular, and is made of an insulating material. Examples of the insulating material include AlN and $Al_2O_3$.

The resistor 2 is formed on the substrate 1, and includes two belt-like portions in the present embodiment. These belt-like portions extend in Direction x, in parallel to and at a distance from each other in Direction y. The resistor 2 contains a resistor material provided by Ag—Pd for example. The resistor 2 may contain crystallized glass such as $SiO_2$—$B_2O_3$—R glass or $SiO_2$—$B_2O_3$—$Al_2O_3$—R glass (where R is provided by one of $ZnO_2$, $LiO_2$ and $TiO_2$).

The electrodes 4 connect the heater A1 with wiring terminals (not illustrated) in the laser printer at the time when the heater is mounted. The electrodes 4 are made of a material containing Ag, for example, as a primary component.

The wiring portions 3 connect the resistor 2 with the electrodes 4, and are formed integrally with the electrodes 4 in the present embodiment. The wiring portions 3 have junctions 31. The junctions 31 establish electrical connection between the two belt-like portions of the resistor 2, and are given a purposeful shape and location for power application in Direction y. The junctions 31 have outlines 31*a* which are inclined uniformly with respect to Direction y.

The protective film 5 protects the resistor 2, and is made of glass. The protective film 5 covers the resistor 2 and part of the wiring portions 3. The protective film 5 is made of a crystallized glass such as $SiO_2$—BaO—$Al_2O_3$—ZnO, and a semi-crystallized glass such as BaO—$SiO_2$ or an amorphous glass such as $SiO_2$—ZnO—MgO. The protective film 5 can be formed through a printing process for example, by first spreading a paste of glass material with a squeegee through a mask-patterned silk screen in Direction x, and then sintering the patterned glass material.

Next, the functions of the heater A1 will be described.

The inventors found that the risk of insufficient supply of the glass material in forming the protective film 5 becomes high when the squeegee runs over a relatively long outline segment of the resistor 2 and the wiring portion 3 extending perpendicularly to Direction x, that is, the moving direction of the squeegee. According to the present embodiment, none of the resistor 2 and the wiring portions 3 which must be run over by the squeegee has an outline segment perpendicular to Direction x. In other words, the outline 31*a* is now slanted with respect to Direction y, whereby the squeegee will never encounter and therefore never have to run over a long gap which extends in Direction y. Therefore, it is now possible to reduce the risk of insufficient supply of the glass material, and hence to increase the withstand voltage of the heater A1.

FIG. 3 through FIG. 7 show other embodiments of the present invention. It should be noted here that in these figures, elements which are the same as or similar to those used in the above-described embodiment are indicated by the same reference symbols. Further, for the sake of easier understanding, protective films 5 are drawn in phantom lines in all plan views of the respective embodiments.

Figure 3:
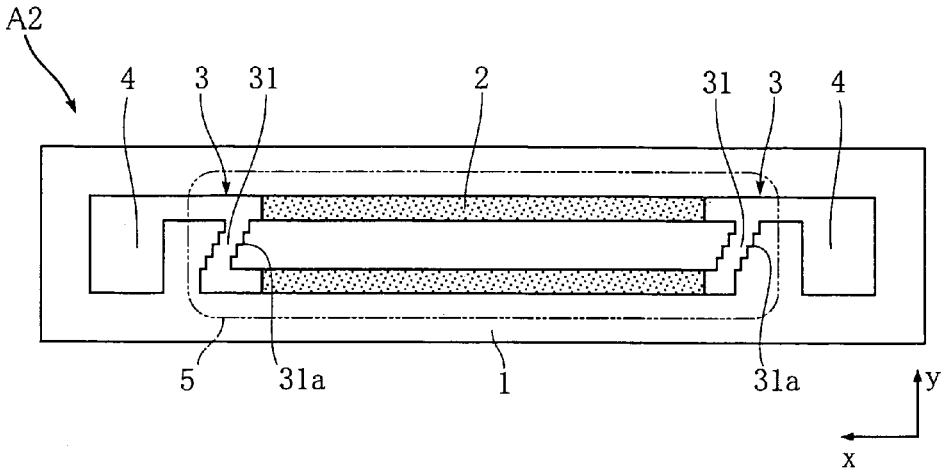
FIG. 3 is a plan view of a second embodiment of the heater according to the present invention.

FIG. 3 shows a second embodiment of the heater according to the present invention. The heater A2 according to the present embodiment differs from the previous embodiment in the shape of the outlines 31*a*. In the present embodiment, the outlines 31*a* are shaped like stairs, with line segments laid in Direction y and line segments laid in Direction x connected alternately with each other. According to such an embodiment as this, the squeegee moves over a relatively short segment of the outline 31*a* which extends in Direction y, one at a time when forming the protective film. Before and/or after moving over any of the segments extending in Direction y, the squeegee moves over one of the segments extending in Direction x. As has been described, there is a relatively high risk of short-supplying the glass material along a segment which extends in Direction y. However, according to the embodiment, it is likely that part of glass material will move to the segments which extend in Direction y, from their preceding and successive pair of segments which lie in Direction x. Thus, it is also possible according to the present embodiment, to reduce the risk of insufficient supply of the glass material, and to increase the withstand voltage of the heater A2.

Figure 4:
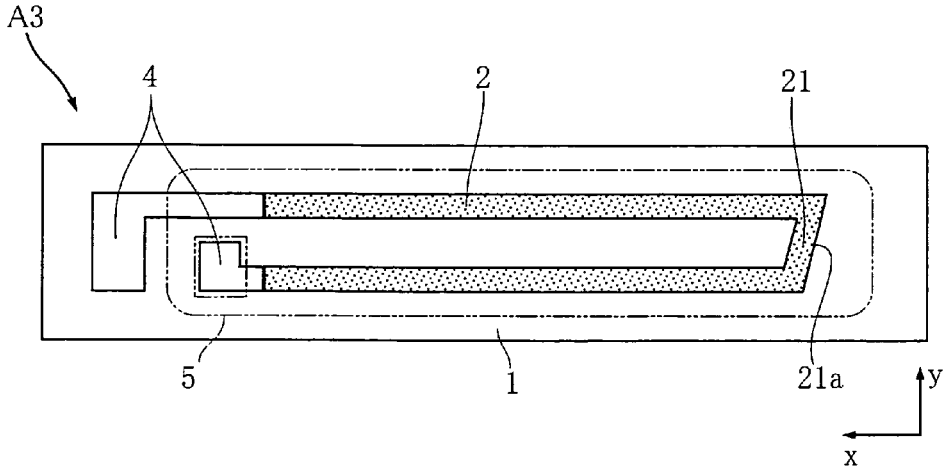
FIG. 4 is a plan view of a third embodiment of the heater according to the present invention.

FIG. 4 shows a third embodiment of the heater according to the present invention. The heater A3 according to the present embodiment differs from any of the two previous embodiments in terms of the shape of the resistor 2. In the present embodiment, the resistor 2 has a shape like a U, including two belt-like portions extending in Direction x and a junction 21 which connects these belt-like portions with each other. The junction 21 establishes electrical connection between the two belt-like portions for power application in Direction y. The junction 21 has outlines 21*a* inclined uniformly to Direction y. According to the present embodiment, it is also possible to reduce the risk of short-supplying the glass material for formation of the protective film 5 along the outlines 21*a*.

As understood from these embodiments, it is possible to reduce the risk of short-supplying the glass material by such an arrangement that part of the resistor 2 or of the wiring portion 3 to be covered by the protective film 5 has an outline which is slanted to Direction x in which the squeegee moves, or by such an arrangement that any segments of the outline which are perpendicular to Direction x are short. The outline of the resistor 2 and of the wiring portions 3 may have any shape as long as it provides such a characteristic as described above. For example, the outline may have a gradually changing curvature in Direction y.

Figure 5:
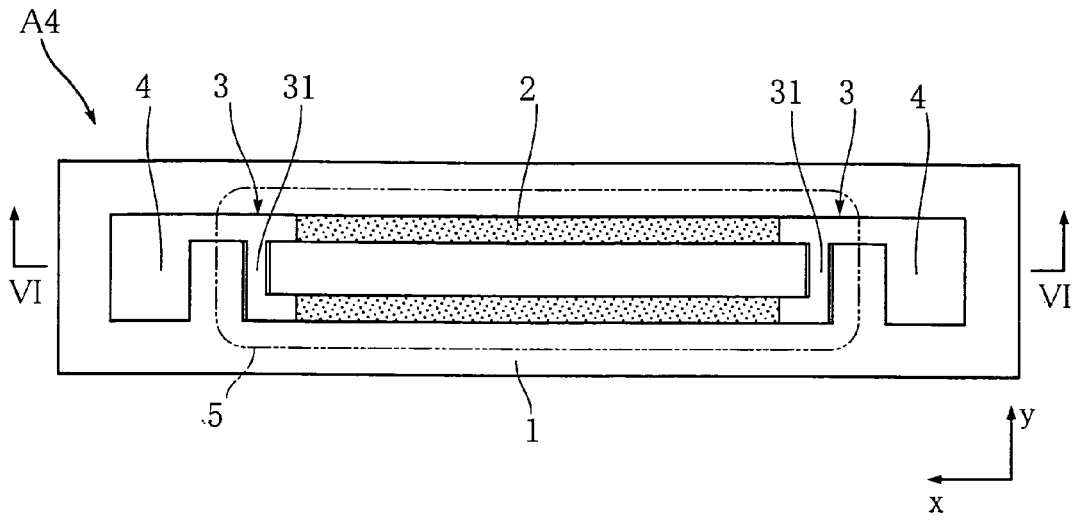
FIG. 5 is a plan view of a fourth embodiment of the heater according to the present invention.
Figure 6:
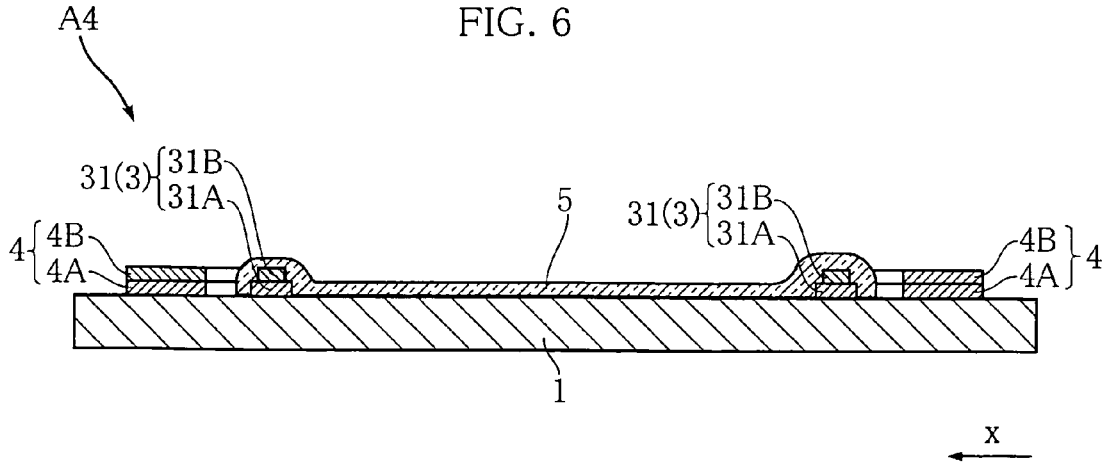
FIG. 6 is a sectional view taken in lines VI-VI in FIG. 5.

FIG. 5 and FIG. 6 show a fourth embodiment of the heater according to the present invention. The heater A4 according to the present embodiment differs from any of the previous embodiments in the configuration of the wiring patterns and the electrodes. In the present embodiment, both of the wiring portions 3 and the electrodes 4 have a two-layer structure. Under this arrangement, each of the junctions 31 includes a first layer 31A and a second layer 31B. The second layer 31B has a smaller width, i.e. a smaller dimension in Direction x, than the first layer 31A, and outlines 31Ba lie more inward than outlines 31Aa in Direction x. Each of the electrodes 4 includes a first layer 4A and a second layer 4B. The first layer 31A and the first layer 4A are formed integrally with each other, and so are the second layer 31B and the second layer 4B.

According to the present embodiment, the junctions 31 have a step-like sectional shape in the direction of height, as shown in FIG. 6. This arrangement decreases the height of a gap which must be run over at one time by the squeegee when forming the protective film 5. Therefore, again, it is possible to reduce the risk of short-supplying the glass material.

Figure 7:
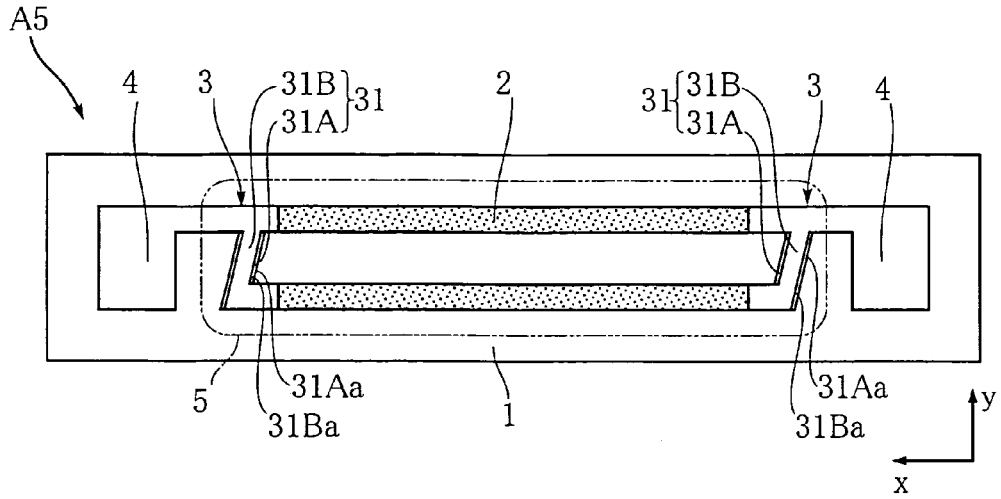
FIG. 7 is a plan view of a fifth embodiment of the heater according to the present invention.
Figure 8:
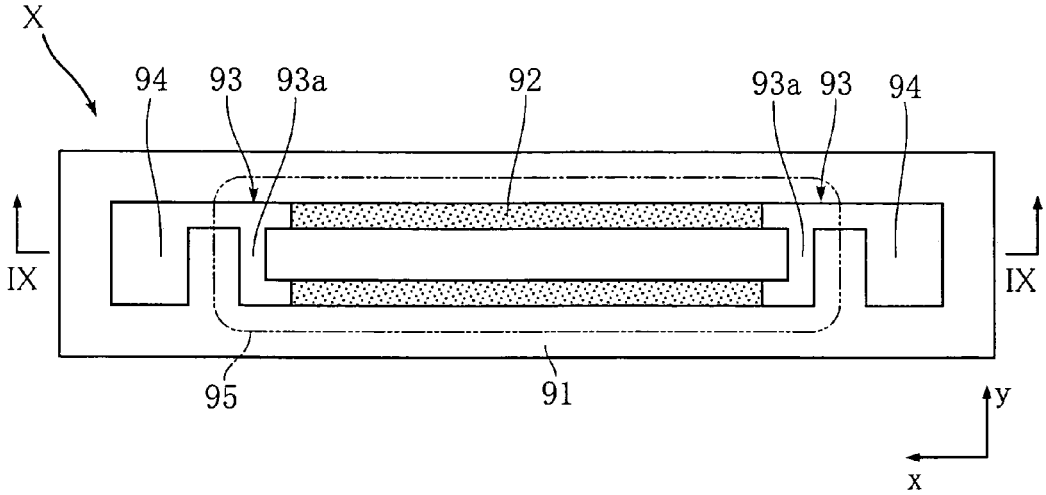
FIG. 8 is a plan view of a conventional heater.
Figure 9:
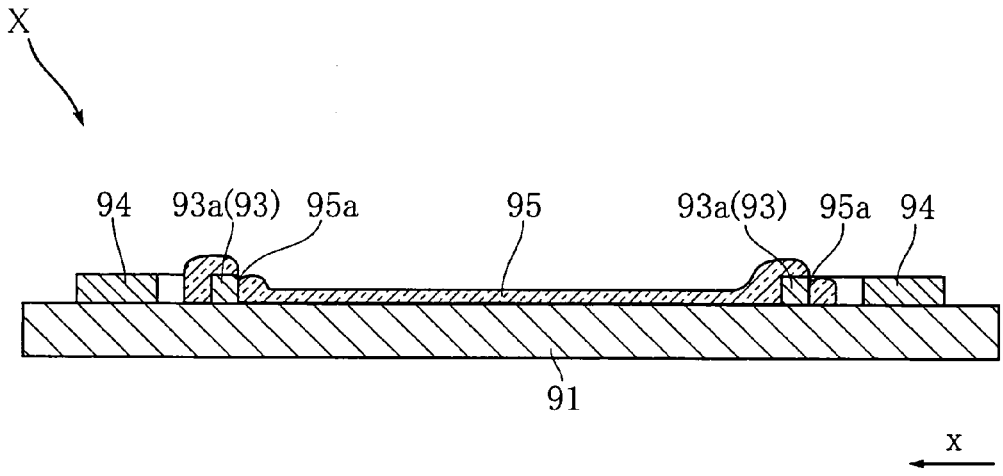
FIG. 9 is a sectional view taken in lines IX-IX in FIG. 8.

FIG. 7 shows a fifth embodiment of the heater according to the present invention. In the present embodiment, the junctions 31 have two layers, and their outlines 31Aa, 31Ba are all inclined uniformly to Direction x. Such an embodiment as described is likely to provide a multiplied effect of the advantage of slanted outlines 31Aa, 31Ba which are not perpendicular to Direction x for the squeegee to run over, and the advantage of decreased height of the gap which must be run over at one time by the squeegee.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A heater comprising:

a substrate elongated in a first direction;

a resistor formed on the substrate and including a pair of belt-like portions elongated in the first direction, the belt like portions being spaced away from each other in a second direction perpendicular to the first direction;

a wiring portion electrically connected with the resistor; and a protective film covering the resistor;

wherein at least one of the resistor and the wiring portion includes a conductive portion for passing an electric current in the second direction, the conductive portion having an edge extending overall in a direction nonparallel to both the first direction and the second direction, the conductive portion being covered by the protective film, wherein the edge of the conductive portion is made up of first straight segments and second straight segments alternating with the first straight segments, the first straight segments being in parallel to the first direction, the second straight segments being in parallel to the second direction, and wherein the first straight segments include two first straight segments connected directly to a common one of the second straight segments, said two first straight segments extending from said common one of the second straight segments oppositely to each other in the first direction.

2. The heater according to claim 1, wherein each of said two first straight segments is smaller in length than said common one of the second straight segments.

* * * * *